United States Patent [19]

Pesce et al.

[11] 4,174,142

[45] Nov. 13, 1979

[54] BRUSH MOUNTING FOR ROTARY ELECTRICAL JOINT

[75] Inventors: Carl A. Pesce, Oak Lawn; Ralph J. Trnka, Dolton; Robert A. Winkless, Oak Lawn, all of Ill.

[73] Assignee: The Continental Group, Inc., New York, N.Y.

[21] Appl. No.: 831,978

[22] Filed: Sep. 9, 1977

[51] Int. Cl.[2] ..... H01R 39/00

[52] U.S. Cl. ..... 339/5 R; 310/242

[58] Field of Search ..... 310/219–226, 310/229–231, 242, 239, 241, 247, 249, 40; 339/5 R, 8 R

[56] References Cited

U.S. PATENT DOCUMENTS

| | | | |
|---|---|---|---|
| 901,976 | 10/1908 | MacMillan | 310/231 |
| 3,544,868 | 12/1970 | Bates | 310/231 |
| 3,596,225 | 7/1971 | Cary | 310/242 |
| 3,681,550 | 8/1972 | Perry | 310/230 |
| 3,769,535 | 10/1973 | Bates | 310/219 |
| 3,942,056 | 3/1976 | Gehring | 310/241 |

FOREIGN PATENT DOCUMENTS

| | | | |
|---|---|---|---|
| 745631 | 5/1944 | Fed. Rep. of Germany | 310/219 |
| 2130242 | 5/1971 | Fed. Rep. of Germany | 310/231 |

*Primary Examiner*—R. Skudy

*Attorney, Agent, or Firm*—Charles E. Brown

[57] ABSTRACT

This relates to the mounting of brushes in a rotary electrical joint in a manner wherein the frictional force applied to a brush by a rotary member is restrained so as to eliminate prior tilting of the brush in a manner wherein excessive wear occurred adjacent the leading edge of the brush. Most particularly, the brush is so restrained wherein any tendency thereof to pivot will occur generally about an axis disposed adjacent the leading edge so that there is a uniform force application of the brush against the rotary member and thus a uniform wearing of the brush.

10 Claims, 6 Drawing Figures

FIG. 1
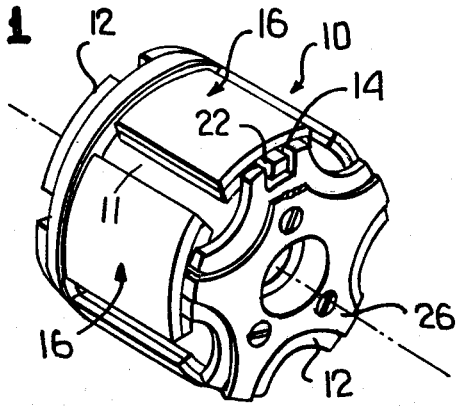
PRIOR ART
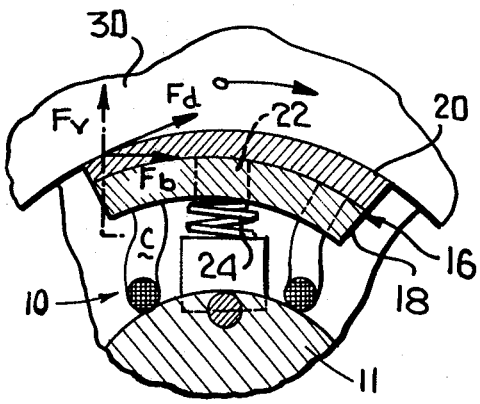
FIG. 2 PRIOR ART
FIG. 3
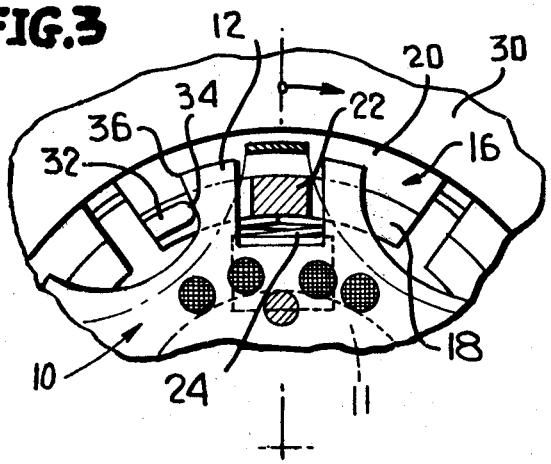
FIG. 4
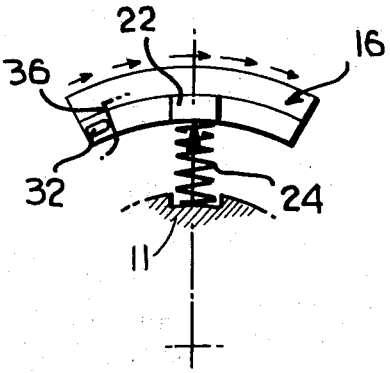
FIG. 5
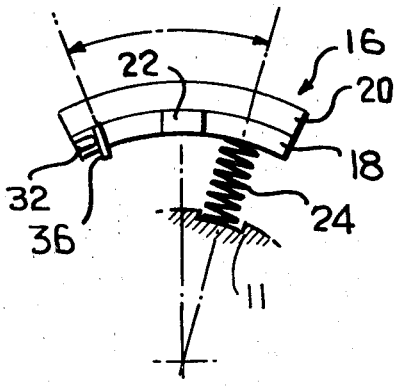
FIG. 6
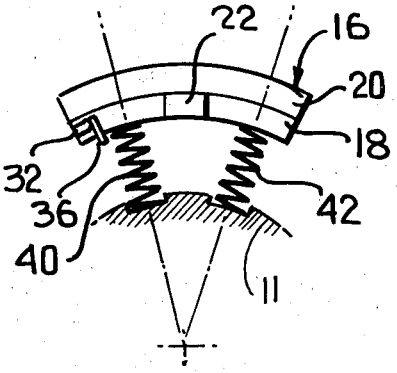

BRUSH MOUNTING FOR ROTARY ELECTRICAL JOINT

This invention relates in general to new and useful improvement in rotary electrical joints, and more particularly to the mounting of the brushes therein in a manner to substantially eliminate uneven wearing of the brushes.

This invention most particularly relates to an improvement in the mounting of brushes of existing rotary electrical joints. Such joints include a hub member which is fixed against rotation and which has rotatably journalled thereon a rotary member. In the existing rotary electrical joints, the brushes have centrally disposed projections which are seated in notches, permitting the brushes to freely move radially while restraining the brushes against rotation with the rotary member engaged therewith. Such an arrangement is found in U.S. Pat. No. 3,596,225 granted to Cary on July 27, 1971.

In the mounting of the rotary brushes, the frictional force applied by the rotary member on the brush in the area of the leading edge of the brush had a tendency to pivot the brush about the middle thereof so that there was a greater than average pressure of the brush against the rotary member adjacent the leading edge of the brush and a lesser than average pressure of the brush against the rotary member adjacent the trailing edge of the brush. This resulted in the undue wearing of the brush with the result that replacement of brushes became more frequent than expected with the necessary shutdown of the equipment of which the rotary joint is a part for the replacement of brushes.

In accordance with this invention, it has been found that if the rotary brushes are mounted with the restraint against rotation of the brushes with the rotary member being adjacent the leading edge of each brush, the rotary brush has a tendency to pivot due to forces exerted thereon by the rotary member with the pivoting taking place generally adjacent the leading edge of the brush with the result that the force tending to pivot the brush is primarily absorbed by the spring which urges the brush against the rotary member and therefore an even wearing of the brush is obtained.

It has also been found that the customary spring urging the brush against the rotary member may be shifted from its normal position to an off-center position towards the trailing edge of the brush. In other forms of the invention, two springs may be utilized with one spring being disposed adjacent the leading edge of the brush and the other being disposed adjacent the trailing edge of the brush. Further, beneficial results may be obtained by making the spring disposed adjacent the leading edge of the brush of a lesser strength than the spring disposed adjacent the trailing edge of the brush.

With the above, and other objects in view that will hereinafter appear, the nature of the invention will be more clearly understood by reference to the following detailed description, the appended claims and the several views illustrated in the accompanying drawings.

IN THE DRAWINGS

FIG. 1 is a perspective view of a hub of a rotary electrical joint having brushes mounted therein in the customary manner.

FIG. 2 is a fragmentary enlarged transverse sectional view through the hub of FIG. 1 and most specifically shows the mounting of a brush and the uneven wearing resulting from such mounting.

FIG. 3 is an end view of a portion of the hub of FIG. 1 showing a brush mounted therein in accordance with this invention.

FIG. 4 is a schematic end view of the brush mounting of FIG. 3.

FIG. 5 is a schematic end view of a slightly modified form of brush mounting.

FIG. 6 is a schematic end view of another modified form of brush mounting.

Referring now to the drawings in detail, it will be seen that there is illustrated in FIG. 1 a hub assembly of a rotary electrical joint, which hub assembly is generally identified by the numeral 10 and is adapted to be stationarily mounted with a rotary member mounted for rotation thereabout. The hub assembly 10 includes a hub 11 which is provided at the opposite ends thereof with radial flanges 12 which are configurated to define a plurality of circumferentially spaced notches 14 disposed radially outwardly of the hub. Generally aligned with each set of the notches 14 and positioned therebetween radially outwardly of the hub 11 is a brush unit, generally identified by the numeral 16. Each brush unit 16 includes a shoe 18 which has bonded to the outer surface thereof a brush 20. The bonding of the brush to its respective shoe is preferably effected by means of a solder having a high electrical conductivity. It is to be understood that when the brushes 20 wear down they may be literally replaced by merely heating the brushes so as to melt the solder and thereafter a like new brush 20 may be soldered to the respective shoe 18. The shoes 18 are preferably formed of copper while the brushes 20 are preferably formed of silver graphite although other metals and alloys may be utilized.

Each brush unit 16 is restrained against rotation about the hub 11 by its respective shoe 18 having at the opposite ends thereof centrally located projections 22 which extend into the notches 14.

As is best shown in FIG. 2, each brush unit 16 is urged radially outwardly by means of at least one central spring 24 and in order to retain the projections 22 in their respective notches, a suitable retainer 26 is mounted at each end of the hub assembly 10 with each retainer 26 having a portion thereof which overlies each notch 14.

With further reference to FIG. 2, it will be seen that mounted for rotation about the hub assembly 10 and frictionally engaging the brushes 20 is a rotary member 30. In order that the necessary electrical energy may be transferred from the brushes 20 to the rotary member 30, it is necessary that the brushes 20 frictionally engage the internal cylindrical survace of the rotary member 30. However, this results in a frictional force being imposed upon each brush unit 16 which tends to tilt the brush unit so that the leading edge of the brush 20 is forced more tightly against the rotary member 30 than the trailing edge of the brush. Most particularly, the projections 22 are forced against the flanges 12 and define a pivot axis for the brush. As is schematically shown in FIG. 2, the resultant drag force Fd is generally tangential and this can be resolved into a horizontal drag force Fh and a vertical drag force Fv. The tilting of the brush provides the vertical drag force Fv with a moment arm C and thus a force moment FvC is generated. On the other hand, the horizontal drag force component Fh is balanced by the reaction of the projection 22 against the flange 12. The net result is that the leading edge of each brush unit 16 tends to move closer to the mating surface of the rotary member 30 which tends to increase the contact pressure on the brush 20 at or near its leading edge. The resultant increase in contact pressure causes increased wear of the brush 20 adjacent the leading edge thereof and thus limits brush life.

In accordance with this invention, brush life will be extended by simply adding to the shoe 18 at each end thereof adjacent the leading edge of the respective brush unit 16 a further projection 32. The projection 32 has a rounded edge 34 which engages a radial guide surface 36. The radial guide surface 36 may be a surface of the associated flange 12 or may be formed as part of a guide added to the flange 12. It is to be understood, however, that the relationship of the projection 32 and the guide surfaces 36 is such that the projections 32 form the sole restraint of the brush units 16 against rotary movement and that the projections 22 do not engage the flanges 12. Thus, the contact between the rounded edges 34 of the projections 32 and the guide surfaces 36 define the pivot axis for the brush unit 16. It will also be apparent from FIG. 3 that the projections 32 are slidable on the guide surfaces 36 in a radial direction to permit the brush unit 16 to be engaged with the mating surface of the rotary member 30.

It will be readily apparent that by providing this additional restraint on the brush unit adjacent the leading edge of the brush unit and by proper application of the spring force, a more uniform pressure is provided between the brush 20 and the rotary member 30.

It is to be understood that the constraint provided by the projections 32 and the guide surfaces 36 eliminates the prior center of rotation and the above discussed moment FvC that caused the non-uniform brush pressure. The spring 24 still generates the outward pressure as before. However, the spring being spaced from the point of brush restraint now uniformly presses the brush 20 against the mating surface of the rotary member 30.

Although it may be desirable to retain the position of the spring 24 in the center of the brush unit as previously provided for, it is to be understood that other beneficial advantages can be obtained by modifying the spring arrangement. Most particularly, with reference to FIG. 5, it will be seen that the spring 24 has been shifted circumferentially and it is now offset from the center of the brush unit 16 to a position adjacent the trailing edge thereof. With the constraint on the brush being adjacent the leading edge thereof, it will be seen that this new location of the spring will provide for a slightly more uniform application of the brush against the rotary member.

Reference is now made to FIG. 6 wherein there is illustrated a slightly modified form of mounting of the brush assembly 16. It is to be noted that in lieu of the single spring or single line of springs 24, two springs 40, 42 are provided. The springs 40, 42 are offset from the center of the brush unit 16 with the spring 40 being disposed adjacent the leading edge and the spring 42 being disposed adjacent the trailing edge of the brush unit. While the springs 40, 42 may be of the same strength, beneficially, the spring 42 should be of greater strength than the spring 40. Thus, any tendency of the leading edge of the brush unit 16 to be forced against the rotary member 30 by the frictional force thereon can be compensated for by the difference in strengths of the springs 40, 42.

Although reference is made to single springs 40, 42, it it to be understood that depending upon the axial dimension of the brush unit 16, more than one spring 40 and more than one spring 42 may be utilized.

Although only several preferred embodiments of the brush mounting in accordance with this invention have been specifically disclosed herein, it is to be understood that minor variations may be made in the disclosed brush mountings without departing from the spirit and the scope of the invention as defined by the appended claims.

What is claimed as new:

1. In a rotary electrical joint of the type including a fixed hub carrying at least one brush and a rotary member having an inner cylindrical surface contacting the brush, a brush mounting for eliminating uneven wearing of the brush, said brush mounting comprising resilient means disposed between said hub and said brush urging said brush radially outwardly, said brush having a leading edge and a trailing edge in accordance with the intended direction of rotation of the rotary member and cooperating restraining means on said brush adjacent said leading edge and carried by said hub for restraining rotary movement of said brush leading edge with said rotary member in response to a drag force applied to said brush by said rotary member when rotating.

2. The brush mounting of claim 1 wherein said restraining means include axial projections at opposite ends of said brush and radially extending guide surfaces carried by said hub engaged by said axial projections in a circumferential direction.

3. The brush mounting of claim 2 wherein said axial projections have rounded edge portions engaging said radial guide surfaces.

4. The brush mounting of claim 1 wherein said brush includes a mounting shoe and said restraining means on said brush are carried by said mounting shoe.

5. The brush mounting of claim 1 wherein said resilient means is a spring positioned substantially centrally between said leading edge and said trailing edge.

6. The brush mounting of claim 1 wherein said resilient means is a spring positioned off center towards said trailing edge.

7. The brush mounting of claim 1 wherein said resilient means includes two radially directed springs disposed in circumferentially spaced relation one each disposed generally adjacent said leading edge and said trailing edge.

8. The brush mounting of claim 7 wherein said spring disposed adjacent said leading edge is of a lesser strength than said spring disposed adjacent said trailing edge.

9. The brush mounting of claim 2 wherein said projections are slidable in a radial direction on said guide surfaces.

10. The electrical joint of claim 1 wherein there are radial flanges at opposite ends of said hub, and said restraining means carried by said hub being portions of said flanges.

* * * * *